United States Patent [19]

Winden et al.

[11] Patent Number: 4,955,497

[45] Date of Patent: Sep. 11, 1990

[54] LITTER CONTAINER

[75] Inventors: Joseph D. Winden, 7382 Treeline Dr., SE., Grand Rapids, Mich. 49506; John A. VerBerkmoes, Nunica, Mich.

[73] Assignee: Joseph D. Winden, Grand Rapids, Mich.

[21] Appl. No.: 318,063

[22] Filed: Feb. 14, 1989

[51] Int. Cl.[5] ..... B65D 51/00

[52] U.S. Cl. ..... 220/408; 270/18

[58] Field of Search ..... 220/1 T, 18, 334

[56] References Cited

U.S. PATENT DOCUMENTS

| | | | |
|---|---|---|---|
| 1,148,261 | 7/1915 | Stephenson | 220/1 T X |
| 4,126,241 | 11/1978 | Klosk | 220/1 T |
| 4,577,778 | 3/1986 | Kim | 220/1 T X |

FOREIGN PATENT DOCUMENTS

| | | | |
|---|---|---|---|
| 1176563 | 8/1964 | Fed. Rep. of Germany | 220/1 T |

*Primary Examiner*—Steven M. Pollard

*Attorney, Agent, or Firm*—Michael A. Mohr

[57] ABSTRACT

A litter container is provided that is particularly adapted for use in urban environments. The litter container comprises an architecturally-styled, substantially cylindrical body which is bolted or otherwise suitably secured to a support surface. An arcuate door is disposed in the cylindrical body, the door comprising a substantially 180° arcuate section of the cylindrical body. A hinge and mounting structure for the door is provided for pivotally mounting and cantilevering the door about a substantially vertical axis. The end of the door opposite the hinge is automatically locked in a closed or latched position by a tamper-proof latch which can only be actuated from the exterior of the litter container by a special key. A corrosion-resistant liner is disposed within the cylindrical body of the container and a chute centered on the axial centerline of the container communicates with the corrosion-resistant liner to direct litter therein. A high-capacity, heavy-duty, extremely durable litter container is thus provided for use in high traffic urban area where maintenance is a problem.

20 Claims, 5 Drawing Sheets

LITTER CONTAINER

BACKGROUND OF THE INVENTION

The invention relates generally to litter containers, and more particularly is directed to a litter container adapted for use in high traffic urban areas where maintenance is a problem.

Litter containers are known in the prior art. Normally, these containers comprise an upstanding body for receiving a litter can, plastic bag, or the like, and a top disposed above the base having one or more spring-loaded doors disposed therein. In large urban environments, such litter cans are necessary for collecting and temporarily storing the refuse of pedestrian and vehicular traffic. However, in such an environment, these litter containers often become the object of vandals who turn over the containers and/or otherwise damage the containers so as to detract from their function and aesthetic appearance.

While a number of relatively durable litter container designs are found in the prior art, they suffer from a number of disadvantages. In many cases, with side entry doors, it is possible to deposit soft drinks and other liquids into the container in such a fashion so that the liquids splash into the container and drain between the corrosion resistant liner and the steel container. This ultimately results in corrosion and premature failure of the container. Another problem encountered when such containers are used in urban areas is vermin. Since it is necessary to bolt or otherwise suitably secure the containers to the ground and latch or securely lock the container lids in place, it is often necessary for maintenance personnel to reach into the container to release the lid latching or locking mechanism. This has been known to lead to injury of maintenance personnel when they are forced to reach into the container to actuate the latch mechanism. Further, the latch mechanisms on these prior art litter containers have themselves been a weak design link since maintenance personnel are known to slam lids and doors closed on the latch mechanism, thereby rendering it inoperable.

SUMMARY OF THE INVENTION

These and other problems in the prior art are solved by provision of a vandal-resistant and aesthetically pleasing litter container for use in urban environments which comprises a substantially cylindrical, architecturally-styled cylindrical body formed almost entirely of a welded steel construction. Fasteners are disposed within the bottom of the cylindrical body for securely mounting the litter container to a support surface. An arcuate door is disposed in the cylindrical body, the arcuate door comprising a substantially 180° arcuate section of the cylindrical body. A hinge and support structure is provided for pivotally mounting and cantilevering the welded steel door about a substantially vertical axis disposed on one end of the door. A latch is disposed on the body for engaging the opposite end of the door and automatically locking the door closed upon closure of the door. The latch can only be actuated from the exterior of the litter container by a special key or tool. The litter container is provided with a first circumferential revel or kickspace disposed at the bottom thereof and a second circumferential revel approximately two-thirds up the side of the cylindrical body. The second circumferential revel separates the cylindrical body of the litter container from a generally cylindrical top. The generally cylindrical top portion includes a spherical dome with a litter-receiving opening centered in the top of the spherical dome. The top includes a chute communicating with the central opening in the top of the spherical dome and a corrosion-resistant liner disposed within the litter container. The chute thus directs liquids and litter from the litter-receiving opening into the center of the corrosion-resistant liner. Two vertically oriented revels are disposed 180°. apart on the cylindrical body portion of the container, the revels defining the edges of the pivotally mounted and cantilevered door which forms a half-section of the cylindrical litter container body. A keyhole disposed on the cylindrical body adjacent one of the vertical revels provides for the insertion of a key for releasing the detent mechanism of the automatic latch. The corrosion-resistant liner can thus be removed from the side of the litter container through the side opening pivotable and cantilevered door without the necessity of reaching into the litter container to release the latch mechanism.

BRIEF DESCRIPTION OF THE DRAWINGS

FIG. 15 is a side elevation view of the cylindrical portion 11 of the litter container 10 illustrating the inside of the litter container with the substantially cylindrical-shaped top portion removed;

FIG. 16 is a fractional cross section of the bottom portion and mounting ring of the litter container;

FIG. 17 is a top plan view of the cylindrical body portion of the litter container with the substantially cylindrical-shaped top portion removed.

DESCRIPTION OF THE PREFERRED EMBODIMENTS

Figure 1:
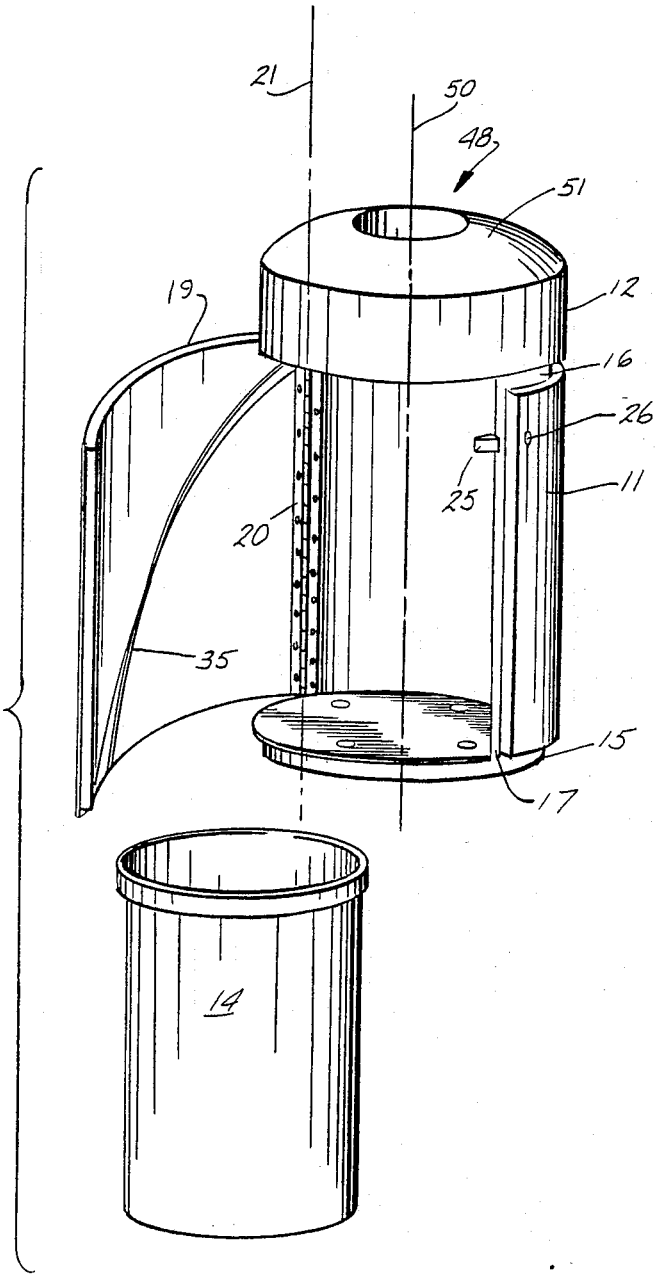
FIG. 1 is an exploded assembly of the litter container of the present invention.
Figure 4:
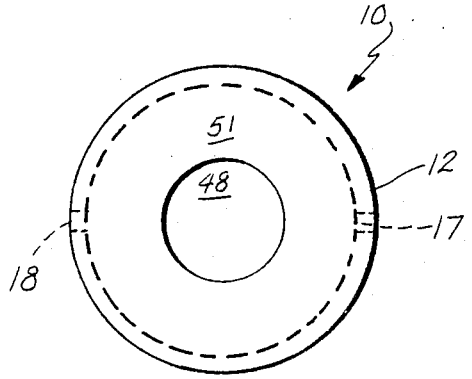
FIG. 4 is a top plan view of the litter container.
Figure 3:
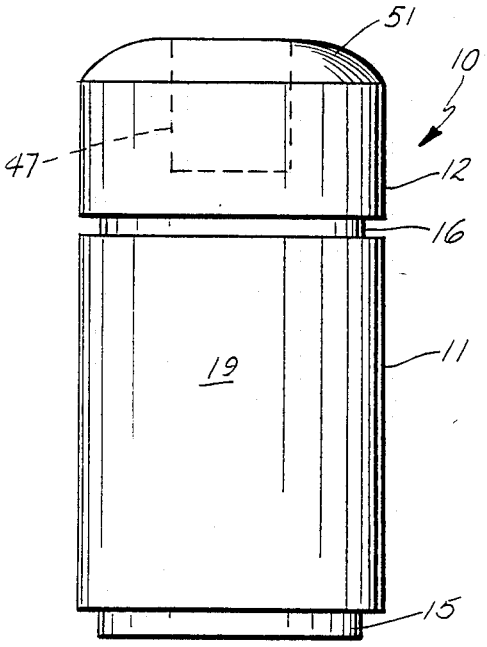
FIG. 3 is a side elevation of the litter container.
Figure 2:
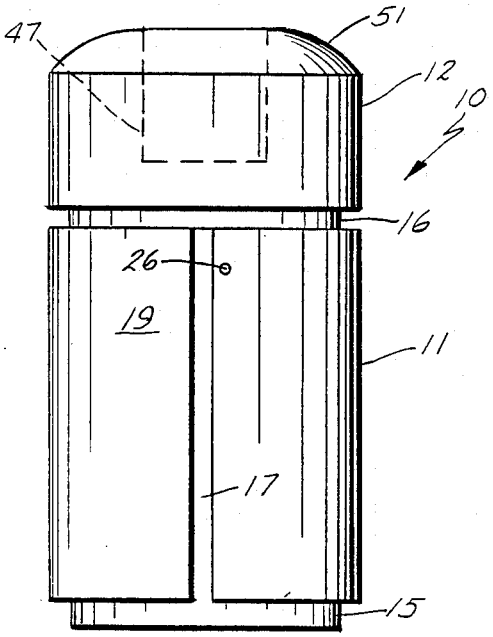
FIG. 2 is a front elevation of the litter container.

With reference now to the Figures and in particular to FIGS. 1, 2, 3 and 4, the litter container of the present invention is generally illustrated at 10. The litter container comprises a generally cylindrical body 11 and a generally cylindrical top portion 12. The litter container is formed almost entirely from a welded steel construction except for a rigid, acid-resistant, high-density, polyethylene liner 14 which fits within the cylindrical body 11 of the container. The corrosion-resistant liner 14 fits snugly within the cylindrical container 11 to prevent litter and liquids from splashing between the corrosion-resistant liner and the metal container. In addition to being provided with a welded steel construction which is extremely durable, the litter container is architecturally styled with a first circumferential revel or kickspace at 15 and a second circumferential revel at 16. The, second revel 16 separates the cylindrical body 11 of the litter container from the substantially cylindrical top 12. Two substantially vertical revels are provided at 17 and 18. The vertical revels are disposed 180 apart on the cylindrical body 11 of the litter container 10. The two vertical revels thus define an arcuate door 19 disposed in the cylindrical body 11, the door comprising substantially a 180 arcuate section of the cylindrical body. A piano-type hinge is provided at 20 for pivotally mounting and cantilevering the door 19 about a substantially vertical axis 21. While one end of the arcuate door 19 is cantilevered and pivotally mounted about axis 21, the other end of the arcuate door 19 is engaged by a latching mechanism featuring a detent disposed at 25 and a key aperture disposed at 26. The latch mechanism provides for the automatic locking of the arcuate door 19 upon the closure of the door and the exterior keyhole 26 is used with a special tool to unlock the latch mechanism to release the door without the need of reaching within the litter container.

Figure 5:
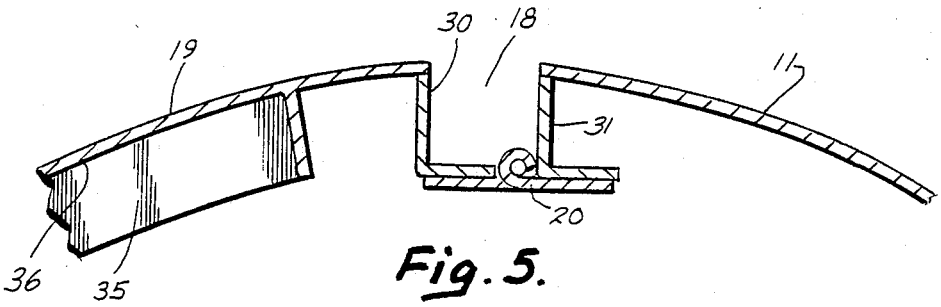
FIG. 5 is a partial section of the litter container taken about the door hinge.
Figure 6:
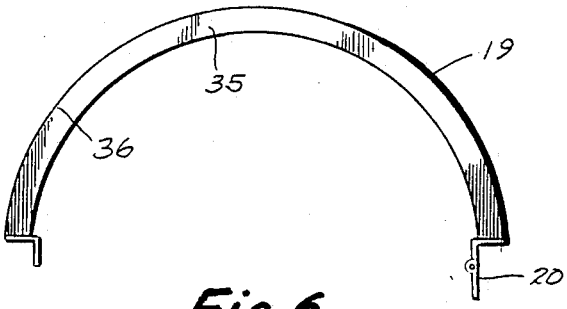
FIG. 6 is a top plan view of the arcuate door of the litter container.
Figure 7:
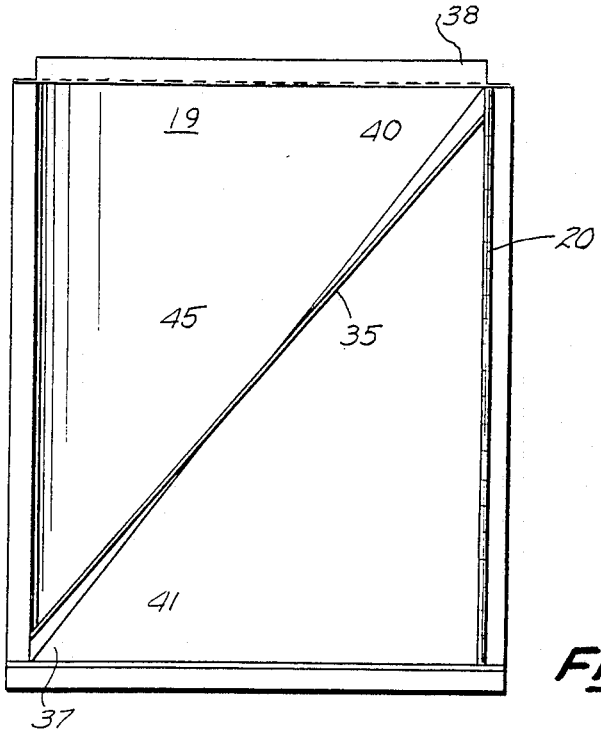
FIG. 7 is an elevational view of the interior surface of the arcuate door of the litter container.

Pivotally mounting and cantilevering the welded steel arcuate door 19 presents a design challenge. A heavy welded steel door of this construction has a tendency to sag. According to the present invention, a suitable support structure for this door is provided by the use of the piano hinge 20 also illustrated in FIGS. 5 and 6. The piano hinge 20 is spot-welded, bolted, or otherwise suitably secured to angle pieces 30 and 31 on arcuate door 19 and cylindrical body 11, respectively, which define the vertical revel 18, best illustrated in FIG. 5. Further, a helical-shaped strap or stiffener 35 is provided which has one axial edge butt-welded to the interior 36 of the arcuate door 19. The stiffener or strap, best illustrated in FIGS. 1 and 7, helically traverses the interior of the arcuate door 19 extending from the top portion 38 of the door adjacent the piano hinge 20 to the bottom portion of the door 39 disposed on the opposite end of the arcuate door. Further, the strap 35 is provided with an axial twist best illustrated in Fig. 7 which produces a downward slope as indicated by the arrow 40 at the top portion 38 of the door and an upward slope as indicated by the arrow 41 at the bottom portion 39 of the arcuate door. The slope of the helically-shaped strap 35 transitions from downwardly sloping to upwardly sloping at approximately the center 45 of the arcuate door 19. This structure provides a suitable support and stiffening mechanism for a welded steel door of 12-gauge construction, which weighs approximately forty pounds.

Figure 8:
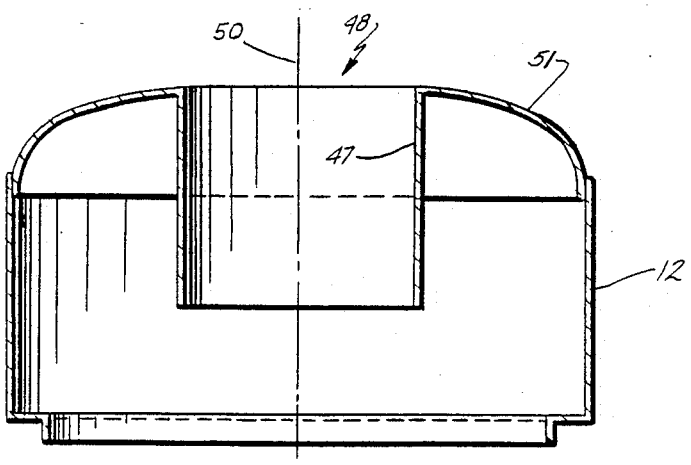
FIG. 8 is a side elevational view in section of the top portion of the litter container.

With reference now also to FIG. 8 which is a detailed illustration of a cross section of the generally cylindrical top portion 12 of the litter container 10, it is illustrated that the generally cylindrical top portion 12 of the litter container is provided with a cylindrical chute 47. The chute 47 communicates with a circular opening 48 which is centered on the central axis 50 of the cylindrical litter container 10. The overall shape of the litter container 10 is that of a right circular cylinder and the axis 50 is the axis of generation for the generally cylindrical container. The chute 47 is welded to the circular aperture 48 disposed in a spherical dome 51 which is welded to the top of cylindrical portion 12. The spherical portion 51 of the top is formed from a steel pressure tank end. The cylindrical chute 47 thus communicates directly with the center of the corrosion-resistant liner 14 disposed within the cylindrical body 11 of the litter container. Debris and liquids deposited or thrown into the chute opening 48 are thus directed downwardly by the chute 47 into the center of the corrosion-resistant liner 14, preventing potentially corrosive liquids from seeping between the corrosion-resistant liner 14 and the steel structure of the litter container.

Figure 9:
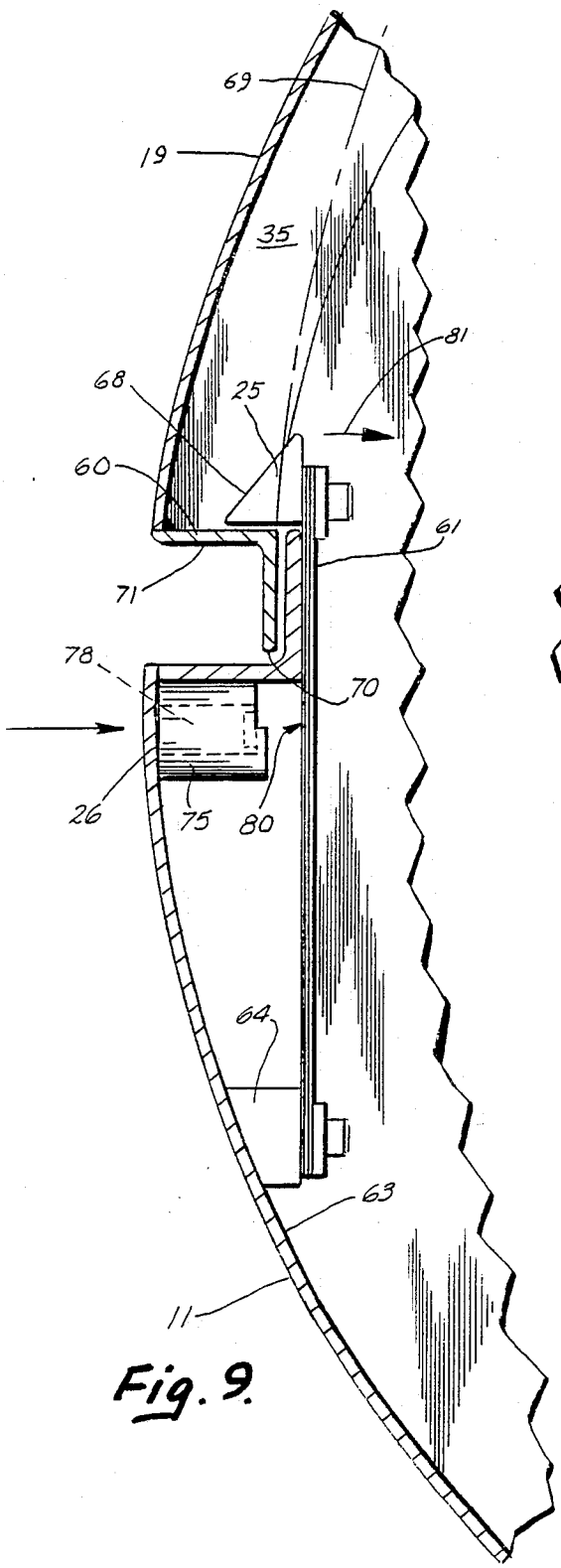
FIG. 9 is a fraction of a cross section view of the litter container taken at the latch mechanism.
Figure 10:
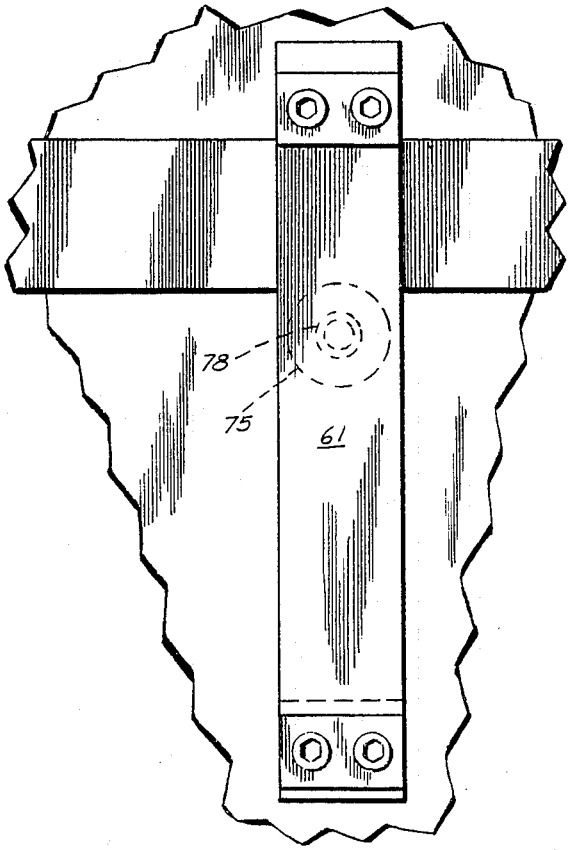
FIG. 10 is a fraction of a side elevation view of the interior of the litter container taken about the latch mechanism.

With reference now also to FIGS. 9 and 10, the latch mechanism of the invention is illustrated in further detail. As described above, the latch mechanism includes a detent 25 which engages a vertical inside edge 60 on one end of the arcuate door 19. Preferably, the detent 25 is mounted on the end of a leaf spring 61 cantilevered from the inside surface 63 of the generally cylindrical body 11 of the litter container. The leaf spring 61 comprises a multi-leaf or multi-element spring with several interleaved layers. This increases the durability or number of life cycles of the spring detent mechanism. The detent mechanism 25 is bolted or otherwise suitably secured to one end of the leaf spring 61 while the other end of the leaf spring 61 is bolted or otherwise suitably secured to a boss 64 which is welded or otherwise suitably secured to the inside 63 of the body of the litter container. A cam surface 68 is disposed on the portion of the detent 25 which faces the arcuate door 19. The cam surface 68 engages the front edge 70 of arcuate door 19 as the front edge travels an arcuate path defined by the line 69 when the door 19 is pivoted to the closed position. The cam surface 68 thus automatically cams the detent 25 around the front edge of the door 19 to a position where the cam snap-locks behind the vertical edge 60 of angle piece 71 of the door 19, locking the door 19 in a closed position. This automatic locking mechanism upon closure of the door, is an important feature since a common failure mode in prior art litter container latch mechanisms involves the failure of these mechanisms upon forceable closure of the door or lid on the latch mechanism.

Another important feature of the latch mechanism of the present invention stems from the provision of a lock block 75 welded or otherwise suitably secured to the interior surface 63 of the litter container body 11. The lock block 75 is disposed proximate the leaf spring 61. The lock block, separately illustrated in FIGS. 11 and 12, includes a key aperture 78 which extends from the outside or exterior of the cylindrical body 11 of the litter container to the interior of the litter container at a point proximate leaf spring 61. This provides for the release of the detent mechanism 25 by insertion of a suitable key or tool in the key aperture 78 for engaging the leaf spring at 80 and displacing the detent 25 in the direction of the arrow 81.

Figure 11:
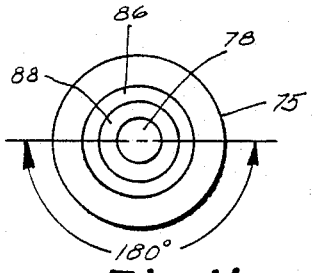
FIG. 11 is an end view of the lock block of the latch mechanism of the litter container.
Figure 12:
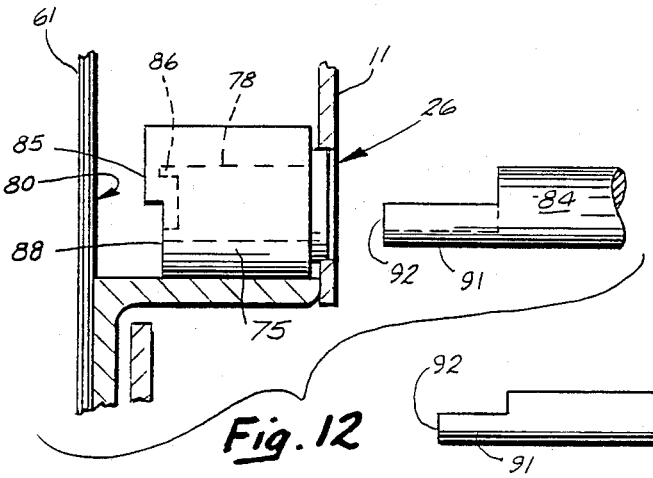
FIG. 12 is an exploded assembly of a portion of the latch mechanism of the litter container illustrating the key as it is inserted in the lock block.
Figure 13:
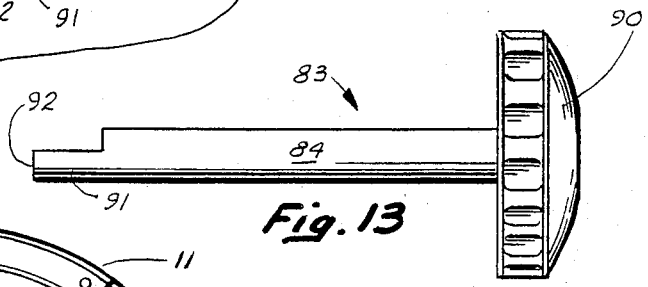
FIG. 13 is a side elevation view of the latch key of the litter container.
Figure 14:
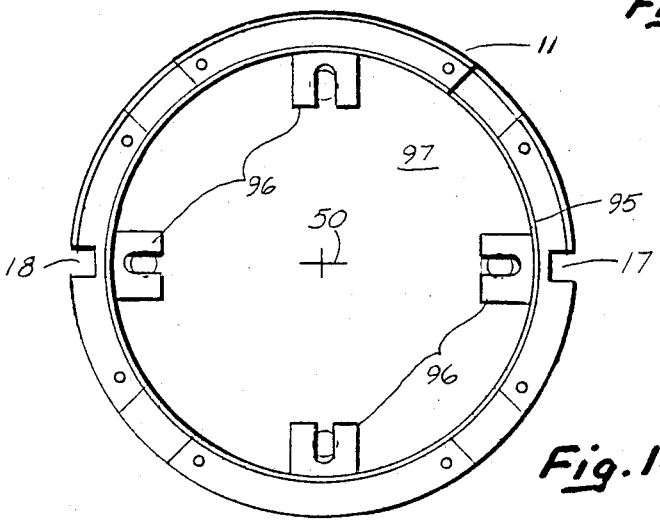
FIG. 14 is a bottom view of the litter container illustrating the mounting ring.

A suitable key or tool for unlocking the latch mechanism is separately illustrated in FIG. 13. The cooperation of this tool and the lock block 78 is best described in detail with specific reference to FIGS. 11 and 12. As described above, the lock block 75 contains a substantially cylindrical key aperture 78 which extends therethrough and communicates with the exterior of the cylindrical litter container at 26. The key, generally illustrated at 83, is provided with a generally cylindrical body 84 which is slightly smaller in diameter than the interior diameter of the key aperture 78. The key aperture 78 is provided with a bottom portion 85 which is distally disposed from the exterior of the litter container 11, the bottom portion 85 having an annular groove 86 disposed therein. A substantially 180° section of the annular groove 86, as best illustrated in FIGS. 11 and 12, is open at 88 to provide for the passage of a specially-designed push rod through lock block 75. This push rod then engages the leaf spring 61 at 80 for displacing the leaf spring 61 and the detent 25 in the direction of the arrow 81 and releasing the door.

More particularly, in the operation of the latch mechanism, the generally cylindrically-shaped body 84 of the key or hand tool 83 is provided with a handle portion 90 disposed on one end thereof and a push rod portion 91 disposed on the opposite end distal from the handle portion 90. The push rod portion 91 comprises a substantially 180° section of a tubular-shaped right circular cylinder which extends axially from the first end of the substantially cylindrical-shaped body of the key 83. This half-section of a right circular cylinder is first registered in the annular groove 86 disposed at the bottom of the cylindrical key aperture 78 when the cylindrical-shaped body 84 of the key 83 is disposed therein. Thereafter, with a turn of the hand key, the push rod 91 is registered with the 180° arcuate-shaped opening disposed in the bottom of the annular groove 86 and with a push of the hand tool 83, the blunt front edge 92 of the push rod 91 engages the leaf spring 61 at 88 to displace the same and release the latch mechanism. This nonstandard tool, not available to vandals and miscreants, thus provides maintenance workers with an easy technique for releasing the latch mechanism and opening the arcuate door 19 without reaching inside the litter container and exposing themselves to filth and/or vermin contained within the litter container.

With reference now to FIGS. 14 through 17, the construction of the cylindrical portion 11 of the litter container 10 is illustrated in further detail. An arcuate bolt ring 95 defines the circumference of the first circumferential revel or kickspace 15. Welded to the bottom of the mounting ring 95 are a number of slotted tabs 96 which are welded to the interior of the mounting ring 95. The tabs 96 are used to bolt the upstanding litter container to a suitable support surface such as a slab of concrete. A deck plate 97 is welded to the top of the mounting ring 95 and is provided with a plurality of access apertures 98 through which threaded fasteners engage studs not illustrated herein which are normally embedded in the concrete slab. Thus, the mounting fasteners which are used to attach the litter container to the concrete slab are disposed within the locked container to eliminate the possibility of tampering.

The above description should be considered exemplary in that of the preferred embodiment only. Modifications will occur to those who make and use the invention. The true scope and spirit of the present invention should be determined with reference to the appended claims. It is desired to include within the scope of the present invention all such modifications that come within the proper scope of these claims.

The embodiments of the invention in which an exclusive property or privilege is claimed are defined as follows.

1. A litter container for use in an urban environment comprising:

a cylindrical body;

fastener means for mounting said cylindrical body on a support surface and resisting overturning moments of the type generated by a heavy cantilevered structure, said fastener means being disposed under said cylindrical body to prevent tampering;

an arcuate door disposed in said cylindrical body, said door comprising substantially a 180 degree arcuate section of said cylindrical body;

hinge means for pivotally mounting and cantilevering said door about a substantially vertical axis disposed on a first end of said door;

latch means for locking said door in a closed position upon closing of said door, said latch means being disposed on a second end of said door opposite said first end; and a substantially helical-shaped stiffener disposed on the interior of said door; said helical stiffener extending from the top of said first end of said door to the bottom of said second end of said door.

2. The litter container of claim 1 wherein said stiffener is a strap with an axial twist, said strap being secured along one axial edge to the interior of said arcuate door.

3. The litter container claim 2 wherein said strap is provided with a downward relative to the interior of said arcuate door proximate top of said door and said strap is provided with an upward relative to the interior of said arcuate door the bottom of said door.

4. The litter container claim 3 wherein the slope of said strap transitions from downwardly sloping to upwardly sloping proximate the of said door.

5. The litter container of claim 1 further comprising a corrosion-resistant liner disposed within said cylindrical body; a substantially cylindrical top disposed atop said body; and a litter chute disposed in said top, said chute communicating with said liner for depositing litter therein.

6. The litter contained claim 5 wherein said litter container comprises a substantially right circular cylinder having a substantially vertically oriented central axis and said chute is vertically oriented and centered on said central axis.

7. The litter container of claim 6 wherein said substantially cylindrical top further comprises a cylindrical section with a spherical dome disposed atop said cylindrical section.

8. The litter container of claim 7 wherein said chute comprises a cylindrical chute secured to the interior of said spherical dome and communicating with an upwardly facing circular opening centrally disposed in said spherical dome.

9. The litter container of claim 1 wherein said hinge means comprises a vertically-oriented piano-type hinge secured to said cylindrical body and said arcuate door.

10. The litter container of claim 1 wherein said latch means comprises a detent for engaging an inside edge of said second end of said door.

11. The litter container of claim 10 wherein said latch means further comprises a leaf spring cantilevered from an interior surface of said cylindrical body.

12. The litter container of claim 11 wherein said detent further comprises a cam surface facing said second end of said door, for engaging said second end of said door and automatically camming said detent over said inside edge of said second end of said door upon closing of said door.

13. The litter container of claim 1 wherein a lock block is disposed on said interior surface of said cylindrical body, said lock block being disposed proximate said leaf spring.

14. The litter container of claim 13 wherein said lock block is provided with a key aperture extending from the exterior of said cylindrical body to the interior of said cylindrical body at a point proximate said leaf spring.

15. The litter container of claim 14 wherein a manually-actuable key is provided for insertion in said key aperture for engagement of said leaf spring, thereby displacing said leaf spring and said detent to release said arcuate door.

16. The litter container of claim 15 wherein said key aperture is provided with a substantially cylindrical shape and said key is provided with a substantially cylindrical shape.

17. The litter container of claim 16 wherein said substantially cylindrical-shaped key aperture is provided with a bottom distally disposed from the exterior of said cylindrical body, said bottom comprising a wall with an annular groove.

18. The litter container of claim 17 wherein a substantially 180 section of said annular groove is open to provide a through passage for a push rod which engages said leaf spring, releases said detent and opens said arcuate door.

19. The litter container of claim 18 wherein said key comprises a handle disposed on a first end of said substantially cylindrical-shaped key and said push rod disposed on a second end of said substantially cylindrical-shaped key, distal from said handle.

20. The litter container of claim 19 wherein said push rod comprises a substantially 180 degree arcuate section of a tubular-shaped right circular cylinder extending axially from said first end of said substantially cylindrical-shaped key, whereby a user manually grasps said key, inserting said substantially cylindrical-shaped key in said substantially cylindrical-shaped key aperture, registering said arcuate section of said push rod first with said annular groove disposed at said bottom of said key aperture and then with a turn registering said arcuate section of said push rod with said through passage disposed in said annular groove for the purpose of engaging said leaf spring and with a push of said handle releasing said detent and opening said arcuate door.

* * * * *